United States Patent [19]

Potter et al.

[11] 4,421,982

[45] Dec. 20, 1983

[54] APPARATUS AND METHOD FOR DOWNHOLE INJECTION OF RADIOACTIVE TRACER

[75] Inventors: Robert M. Potter, Los Alamos; Jacobo R. Archuleta, Espanola; Conrad F. Fink, Los Alamos, all of N. Mex.

[73] Assignee: The United States of America as represented by the U.S. Department of Energy, Washington, D.C.

[21] Appl. No.: 159,890

[22] Filed: Jun. 16, 1980

[51] Int. Cl.[3] ..... G01V 5/00

[52] U.S. Cl. ..... 250/260; 250/259

[58] Field of Search ..... 250/259, 260, 356, 266

[56] References Cited

U.S. PATENT DOCUMENTS

| | | | |
|---|---|---|---|
| 2,856,536 | 10/1958 | Cardwell, Jr. et al. | 250/260 |
| 2,989,631 | 6/1961 | Bohn | 250/260 |
| 3,070,696 | 12/1962 | McEwen | 250/260 |

FOREIGN PATENT DOCUMENTS

| | | | |
|---|---|---|---|
| 263765 | 11/1970 | U.S.S.R. | 250/303 |
| 306438 | 11/1975 | U.S.S.R. | 250/259 |

*Primary Examiner*—Alfred E. Smith
*Assistant Examiner*—Carolyn E. Fields
*Attorney, Agent, or Firm*—Robert W. Weig; Paul D. Gaetjens; Richard G. Besha

[57] ABSTRACT

The disclosure relates to downhole injection of radioactive $^{82}Br$ and monitoring its progress through fractured structure to determine the nature thereof. An ampule containing granular $^{82}Br$ is remotely crushed and water is repeatedly flushed through it to cleanse the instrument as well as inject the $^{82}Br$ into surrounding fractured strata. A sensor in a remote borehole reads progress of the radioactive material through fractured structure.

6 Claims, 6 Drawing Figures

APPARATUS AND METHOD FOR DOWNHOLE INJECTION OF RADIOACTIVE TRACER

This invention is a result of a contract with the Department of Energy (contract W-7405-ENG-36).

BACKGROUND OF THE INVENTION

The invention relates to an apparatus and method for downhole injection of a radioactive tracer. At least two boreholes are used. Progress of the radioactive tracer forced through fractured structure from one borehole to another is followed by at least one downhole detector.

A prior art practice of determining the nature of interborehole fractured structure utilizes radioactive $^{131}I$. After it is poured down a borehole, water is pumped into the hole to force the iodine tracer through the fractured structure. Several problems and disadvantages exist when iodine is used. First of all it is very expensive. Secondly, the tool used remains radioactively hot for at least three months and must be stored and not used. Extreme care must be exercised in withdrawing and storing the tool because it is contaminated. Thirdly, workmen in the field tend to be cavalier with the iodine and it slops on the ground, on their shoes and clothing, and the like. Therefore not only is the iodine itself expensive but it is costly to use and there are many hazards associated with its use. A preferred embodiment of the invention uses a radioactive isotope of $^{82}Br$ enclosed within a capsule in granular form. The half-life of the bromine is 1½ days compared to the 8 day half-life for $^{131}I$, meaning $^{82}Br$ is safer from this standpoint. Too, the nonselective biological response of the $^{82}Br$ provides greater safety in addition to its added usefulness ,ecause of its short half-life. Workmen need not handle radioactive material itself in practicing the invention. There is thus no occasion for it to be slopped on the ground or onto a workman's shoes or clothing. In addition, because the tool head is repeatedly flushed with water, upon its return to the surface it can be immediately handled by workmen with complete safety. The radioactivity of the tool head can be monitored by a detector disposed in its proximity, to ensure that it is essentially free of radiative material before it is returned to the surface. Because of these features, workmen can safely handle a tool with bare hands immediately upon its retrieval from downhole; the tool can be immediately reused and need not be put on the shelf for three months as when $^{131}I$ is used.

SUMMARY OF THE INVENTION

In accordance with the present invention there is provided an apparatus and method for monitoring interborehole fractured structure. A downhole injector is provided for dispersing a tracer material such as granular or powdered material comprising a radioactive isotope such as $^{82}Br$. The tracer element is enclosed within a container such as a quartz ampule, and is shielded by an encompassing tool head. The tool is lowered into a borehole to a selected depth and the ampule is broken by, for example, a dc motor driven ram, to release its contents which are then injected into the surrounding strata by flushing the tool head with water. The progress of the tracer through the fractured strata is monitored by a detector in at least a second borehole and, if desired, by one near the tool. The tool is then flushed by a motor driven piston a plurality of times with water until it is sufficiently cleansed for manual handling. It can then be withdrawn for immediate safe use again. A detector may be disposed near the tool to monitor its dispersal of the tracer and the tool cleansing step.

One object of the present invention is to provide safe monitoring of interborehole fractured structure.

Another object of the present invention is to provide monitoring using a material having superior radioactive properties than prior art materials for monitoring fractures.

One advantage of the present invention is that a tool can be cleansed downhole to free it of all radioactive contamination; it can then be immediately manually handled and reused.

Another advantage of the instant invention is that workmen using it are exposed to less radiation hazards than with prior art devices and methods.

BRIEF DESCRIPTION OF THE DRAWINGS

Reference is now made to the drawings wherein like numbers denote like parts and wherein.

DETAILED DESCRIPTION OF A PREFERRED EMBODIMENT OF THE INVENTION

Figure 1:
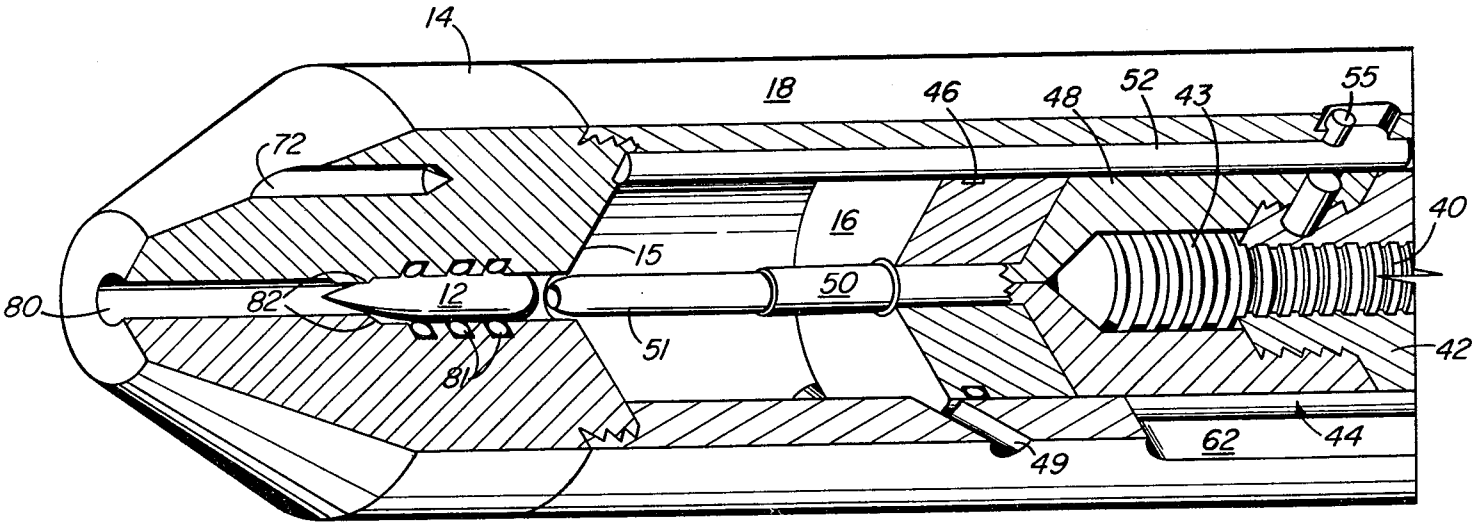
FIGS. 1, 2, 3 and 4 show a preferred embodiment of a downhole injector and gamma ray detector in accordance with the present invention.
Figure 2:
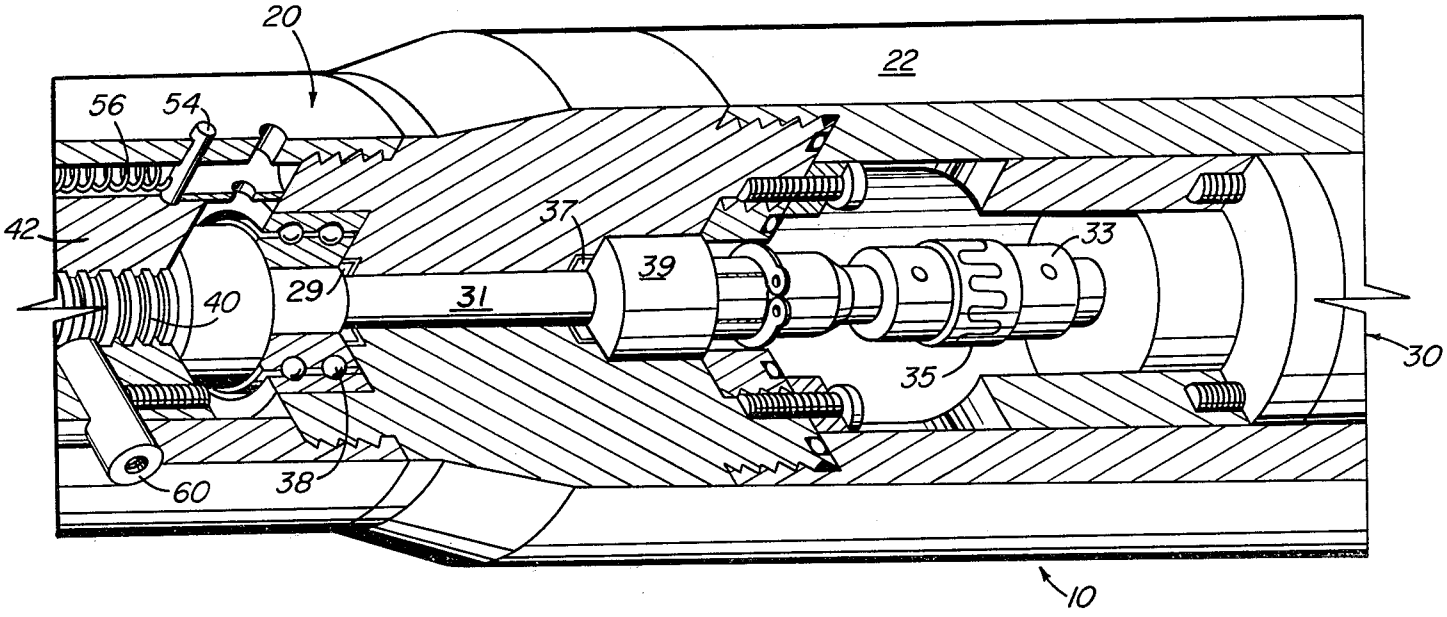
Figure 3:
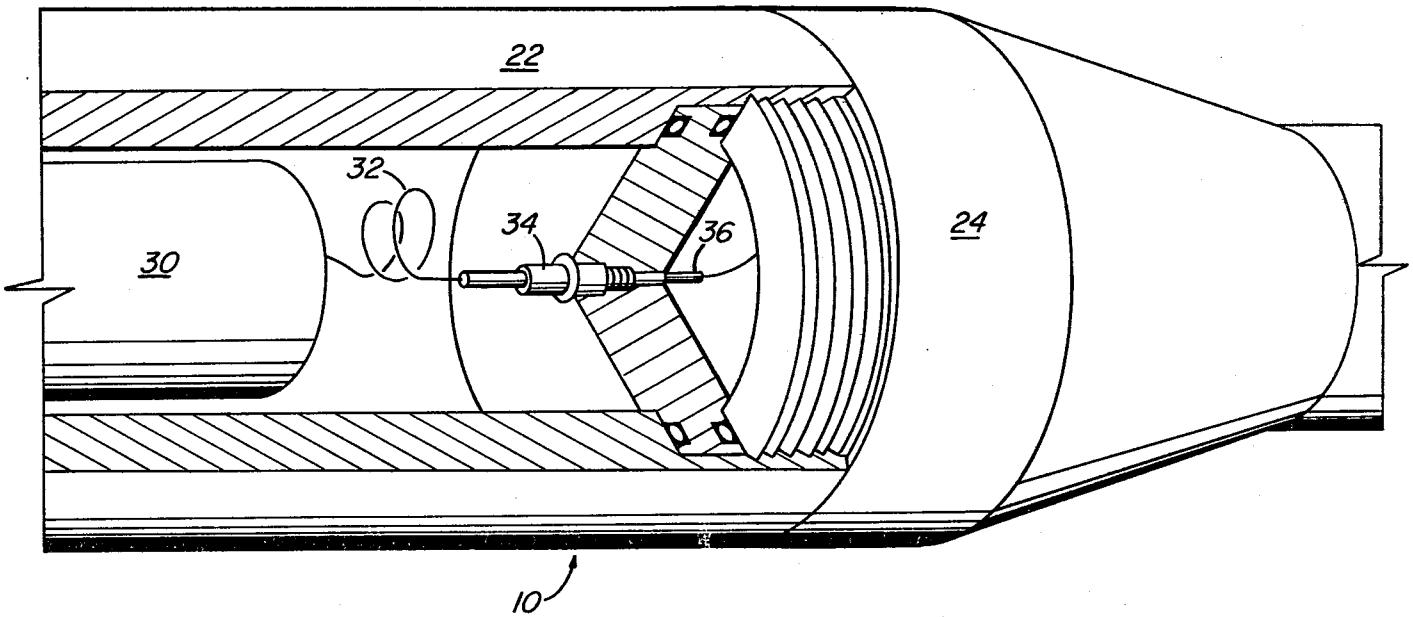
Figure 4:
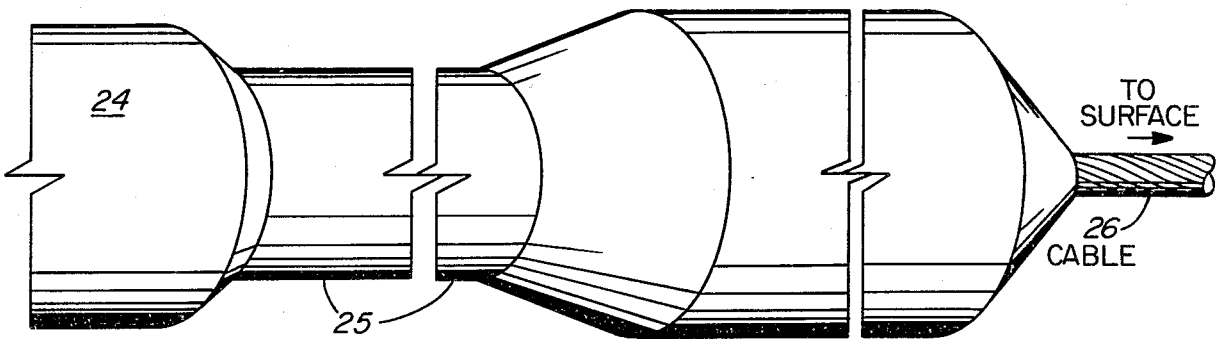

Reference is now made to FIGS. 1–4 which show a downhole injector and gamma ray detector tool assembly 10 containing in a toolhead 14 a quartz ampule 12 which contains preferably in granular form a radioactive tracer element such as $^{82}Br$ to be used in monitoring a fractured structure. The head 14, a piston 16, as well as the major structural portions of tool 10 comprise heavy metal shielding to protect workmen from radiation emitted by the contents of ampule 12. Head 14 is threaded onto a casing portion 18 which threads at a joint structure 20 into a second casing portion 22. Adaptor 24 connects casing portion 22 to a gamma ray detector 25, thence to a multiconductor wire line logging cable 26 of a conventional type. A dc motor 30 disposed within casing portion 22 connects to a voltage source (not shown) at the surface through wire 32, connector 34 and wire 36. Motor 30 through a drive shaft 33 and a connection 35 connects to a drive shaft 31 which is rotatable within the assembly, seals 29 and 37 and bearings 38 and 39 separating the lower portion casing 18 from the second casing portion 22 which contains motor 30 so that the lower portion 18 can be flushed with water without any of it entering the electric motor. Drive shaft 31 rotates a lead screw 40 which threads into a sliding threaded bulkhead 42. The end 43 of screw 40 rotates in intermediate bulkhead 48. Bulk heads 42, 48 and piston 16 move as a single bulk head-piston assembly 44. Piston 16 having seal 46 flushes water which enters through orifice 49 out orifice 80. A ram 50 having a head 51 is driven by sliding bulk head-piston assembly 44 as moved by motor 30 turning lead screw 40 to crush ampule 12. Distance moved by assembly 44 is limited by surface 15 of head 14. Pin 54 mounted spring 56 spring loads rod 52 movable by pin 55 to lock the head 14 from inadvertently unscrewing from 18 and become lost in the well. The distance travelable by assembly 44 is limited by pin 60 travel range in slot 62. Ampule 12 rests against shoulders 82, the O-rings 81 shock mounting it. Assembly 44 moves any water beween head 14 and piston 16 which enters through orifice 49 over crushed ampule 12 and out orifice 80 when the ampule is crushed. Ram head 51 is sufficiently small in diameter to pass through orifice 80, water flowing between orifice 80 and ram head 51 out of the unit as piston 16 pushes downward. Because slot 80 is narrower at the downhole end of head 14, the ampule can not slide out downhole but is crushed against shoulder 82 when contacted by ram head 51.

Figure 5:
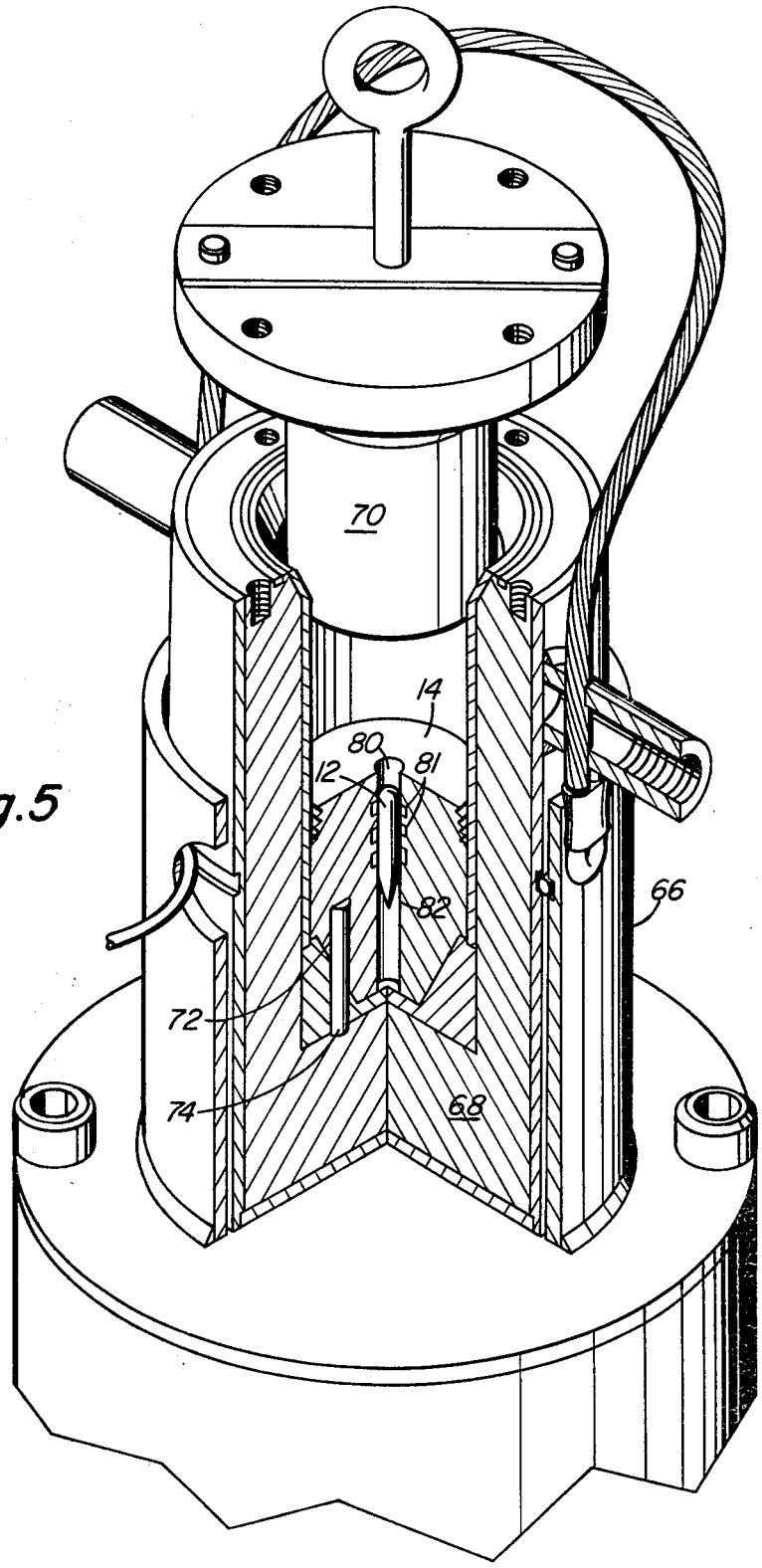
FIG. 5 shows a lead pig assembly for containing an ampule of radioactive material to be used in the embodiment of FIGS. 1–4.

As seen in FIG. 5, prior to assembly of the tool, ampule containing head 14 can be carried in a lead pig 66 comprising shielding 68 and shielding cap 70. The head 14 has a keying slot 72 for receiving pin 74 affixed in pig 66, appropriately positioning the head within the container. In practicing the invention, after cap 70 is removed from pig 66, assembly 10 can be vertically lowered onto head 14 contained within the pig and threaded thereto, the pin 74 keeping head 14 from rotating within the pig while being attached to the assembly 10. This can all be accomplished without a workman being exposed to the cone of radiation emitted through orifice 80 surrounding ampule 12.

Figure 6:
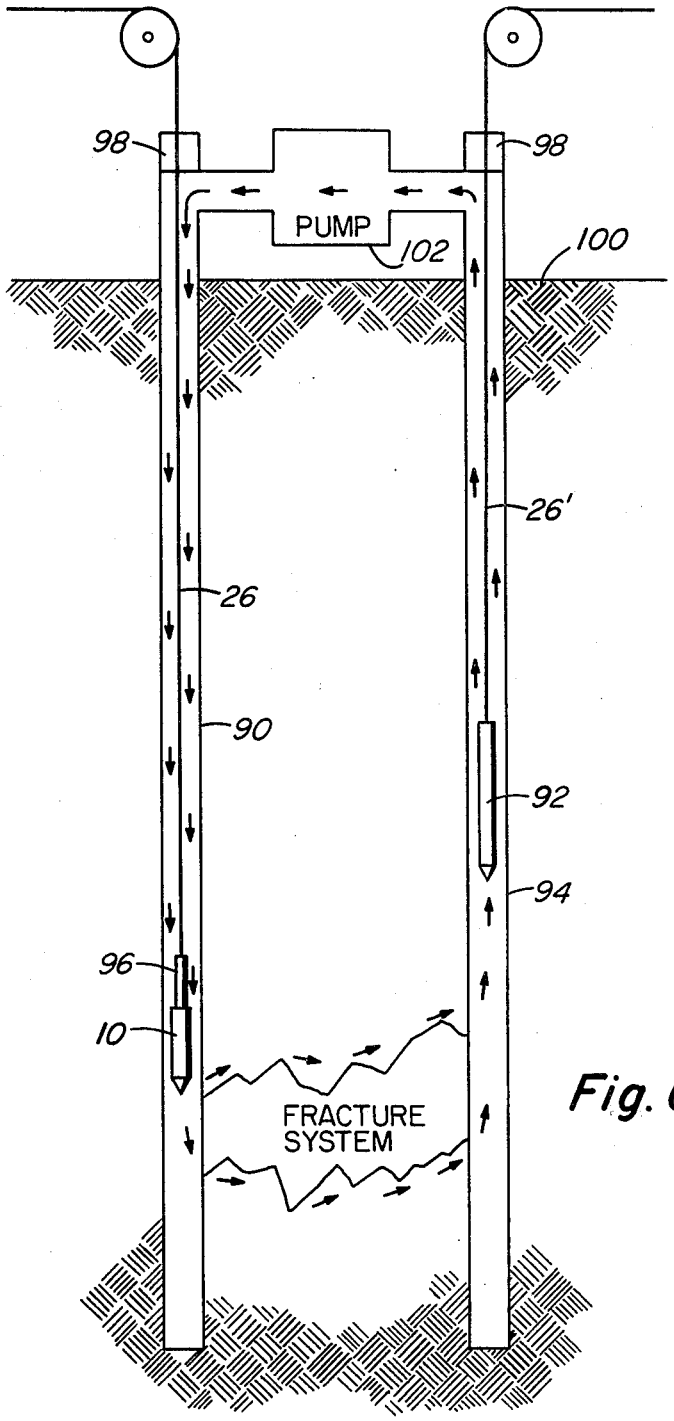
FIG. 6 shows the preferred embodiment of FIGS. 1–4 in use monitoring a fractured structure.

Reference is now made to FIG. 6 which shows schematically across a section of terrain having a surface 100 assembly 10 down a borehole 90, and a gamma detector 92 down a second borehole 94. Assembly 10 has an optional gamma detector 96 fastened over it and the combination is lowered on multiconductor containing cable 26, detector 92 being lowered on another cable 26'. Cable packing 98 is provided about the cables above the surface of the ground. The instruments are each lowered to a selected depth and when assembly 10 is believed to be within the vicinity of a selected fractured structure about which information is desired, ram 50 therein is caused to crush ampule 12 by the action of motor 30 acting through shaft 31 and lead screw 40. This breaks the ampule and the radioactive tracer therein is released. Water is pumped downhole through borehole 90 by a pump 102. The water distributes itself through the fractured structure and returns to the surface through second borehole 94. The movement of sources of radioactivity in the water is monitored by detector 92 which may be raised and lowered about its selected depth and from this information the nature of the fractured structure can be determined. A second detector 96 optionally mounted atop assembly 10 is used to determine when the tracer is released and how long and at what concentration it remains in the borehole. The second detector determines when water which is flushed through assembly 10 a plurality of times removes all the radiation being emitted by any remaining tracer therein as well as the entry position of the water in the fractured system. When the assembly 10 is clean it can be returned to the surface and handled manually by workmen without any type of protection. The assembly 10 if desired can then be immediately refitted with another ampule containing head 14 from a pig assembly 66 and relowered into the borehole for a second release of radiation radioactive material. Those skilled in the art will appreciate what type of information can be obtained about fractured structure from tracing the movement of radioactive material in water forced therethrough.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A downhole injector for dispersing a material comprising radioactive tracers into fractured strata comprising:

means for receiving and shielding an ampule containing said dispersible material;

electric motor driven means for breaking said ampule and for forcing its contents from said injector into surrounding strata; and means for flushing said receiving and shielding means and said breaking means a plurality of times to cleanse them sufficiently of radioactive contamination to allow for their immediate safe handling upon their withdrawal from a borehole.

2. The invention of claim 1 wherein said dispersible material comprises granular material.

3. The invention of claim 1 wherein said breaking means comprises a ram.

4. The invention of claim 1 wherein said material comprises a powder.

5. The invention of claim 1 wherein said material comprises $^{82}Br$.

6. A method for determining water circulation in fractured structure comprising:

providing at least two spaced boreholes disposed across a fracture system;

lowering a radioactivity detector into one of said boreholes to a selected depth;

lowering to a selected depth in the other borehole a downhole injector having soluable radioactive material contained within a capsule;

breaking the capsule with the injector;

pumping water through the injector a plurality of times to dissolve the radioactive material therein and to release the material into the fracture system;

monitoring the radioactivity in the one borehole caused by the release of radioactive material into the fracture system by lowering and raising the detector about the selected depth; and lowering a second radioactivity detector downhole with the injector to determine when said radioactive material is released and how long and at what concentration it remains in the borehole.

* * * * *